US007464765B2

(12) United States Patent
Isaacks et al.

(10) Patent No.: US 7,464,765 B2
(45) Date of Patent: Dec. 16, 2008

(54) INNER GUIDE SEAL ASSEMBLY AND METHOD FOR A RAM TYPE BOP SYSTEM

(75) Inventors: C. Steven Isaacks, Cypress, TX (US); Harry P. Hiebeler, Houston, TX (US); Noe Tony Cordova, Houston, TX (US); Jimmy G. Livingston, Jr., Tomball, TX (US); Russell C. Gilleylen, Houston, TX (US); Haresh Ghansyam, Houston, TX (US)

(73) Assignee: National-Oilwell DHT, L.P., Houston, TX (US)

( * ) Notice: Subject to any disclaimer, the term of this patent is extended or adjusted under 35 U.S.C. 154(b) by 289 days.

(21) Appl. No.: 11/211,941

(22) Filed: Aug. 24, 2005

(65) Prior Publication Data

US 2007/0044976 A1 Mar. 1, 2007

(51) Int. Cl.
*E21B 33/06* (2006.01)

(52) U.S. Cl. ..... 166/378; 166/85.4; 251/1.3

(58) Field of Classification Search ..... 166/85.4, 166/84.3, 378; 251/1.1, 1.3; 277/632
See application file for complete search history.

(56) References Cited

U.S. PATENT DOCUMENTS

| | | | | |
|---|---|---|---|---|
| 2,746,709 | A | 5/1956 | Minor | 251/1 |
| 2,850,256 | A | 9/1958 | Crookston et al. | 251/1 |
| 3,692,316 | A | 9/1972 | Bishop et al. | 277/73 |
| 4,580,626 | A | 4/1986 | Jones | 166/55 |
| 4,646,825 | A | 3/1987 | Van Winkle | 166/55 |
| 4,690,411 | A * | 9/1987 | Van Winkle | 277/325 |
| 4,911,410 | A | 3/1990 | Baker | 251/327 |
| 4,943,031 | A | 7/1990 | Van Winkle | 251/1.3 |
| 4,997,162 | A | 3/1991 | Baker et al. | 251/327 |
| 5,294,088 | A * | 3/1994 | McWhorter et al. | 251/1.3 |
| 5,590,867 | A | 1/1997 | Van Winkle | 251/1.3 |
| 5,603,481 | A * | 2/1997 | Parker et al. | 251/1.3 |
| 5,833,208 | A * | 11/1998 | Lee, Jr. | 251/1.3 |
| 5,863,022 | A | 1/1999 | Van Winkle | 251/1.1 |
| 6,006,647 | A | 12/1999 | Van Winkle | 91/41 |
| 6,039,324 | A * | 3/2000 | Santa, Jr. | 277/606 |
| 6,089,526 | A * | 7/2000 | Olson | 251/1.3 |
| 6,244,336 | B1 | 6/2001 | Kachich | 166/55 |

(Continued)

OTHER PUBLICATIONS

International Search Report and Written Opinion, Aug. 3, 2007, for foreign counterpart PCT Application PCT/US06/28087.

*Primary Examiner*—Jennifer H Gay
*Assistant Examiner*—Robert E Fuller
(74) *Attorney, Agent, or Firm*—Howrey LLP

(57) ABSTRACT

An improved ram inner seal assembly used in ram-type BOPs is disclosed. The disclosed invention provides an inner guide seal assembly that comprises a specially shaped guide body and a separate sealing element. When the ram-type BOP is closed, two opposing rams move toward one another, and the inner guide seal assembly guides a wireline (or other tubular) toward the center of the vertical bore through the BOP. The inner guide seal assembly's proximity to the ram body's centerline axis helps ensure that a positive seal is formed and that no damage occurs to the device in the central bore of the BOP. The separate, specially-shaped sealing element can be easily inserted into and removed from the guide body of the inner guide seal assembly for easy replacement.

20 Claims, 3 Drawing Sheets

U.S. PATENT DOCUMENTS 6,296,225 B1 * 10/2001 Watts ..... 251/1.3
6,367,804 B1 * 4/2002 Watts ..... 277/325
6,719,042 B2 4/2004 Johnson et al. ..... 166/55
6,739,598 B1 * 5/2004 Saarem ..... 277/616
6,974,135 B2 * 12/2005 Melancon et al. ..... 277/325
7,243,713 B2 * 7/2007 Isaacks et al. ..... 166/85.4

* cited by examiner

INNER GUIDE SEAL ASSEMBLY AND METHOD FOR A RAM TYPE BOP SYSTEM

FIELD OF THE INVENTION

The present invention relates to ram-type blowout preventers ("BOPs") used in oil and gas operations for well control including preventing a well blowout. In particular, the present invention relates to the design and use of an improved ram inner seal assembly used in ram-type BOPs.

BACKGROUND OF THE INVENTION

Wireline BOPs are typically included in the surface assembly at a wellhead when conducting well intervention services. The wireline BOP is typically installed below a grease injection head. In use, grease is pumped into the lower end of the grease injection head at some pressure above well bore pressure. Often, the grease is pumped into the grease injection head at 1.2 times well bore pressure.

By pumping grease into the grease injection head at a pressure above well bore pressure, the grease prevents well bore pressure from migrating past the lower end of the grease injection head. Additionally, because the grease surrounds the wireline that passes through the grease injection head, the grease prevents hydrocarbons from the well bore from flowing into and around the wireline and, thus, prevents migration of well fluids past the grease injection head.

While grease injection heads have proven very successful at holding back well bore pressure while conducting well intervention services, grease injection heads have sometimes failed to maintain an effective "grease seal" adequate to hold back well bore pressure. The grease seal can fail for any number of reasons, including the well experiencing a pressure spike while the intervention services are being performed and/or the grease thinning due to exposure to increased temperatures or well chemicals. On the rare occasions that a grease injection head fails to maintain an adequate grease seal, the rams of the wireline BOP are actuated to seal around the wireline and hold back well bore pressure.

Typically, a wireline BOP is equipped with multiple BOP rams that are assembled in a vertical stack that is positioned over and connected to the wellhead. The BOP has a central valve body with a vertical bore running through it. Wireline extends up through the center, vertical bore of the BOP stack. Depending on the operations being conducted on the well, other wellbore equipment may be within the vertical bore of the BOP stack at a particular time.

A typical wireline BOP has a plurality of laterally disposed, opposing actuator assemblies fastened to the valve body. Each actuator assembly includes a piston that is laterally moveable within an actuator body by pressurized hydraulic fluid (during normal operation) or by manual force (in the event of a failure of the hydraulic control system). Each piston has a stem threadably engaged or otherwise connected to it. The stem extends laterally toward the bore of the valve body and has a ram body attached to the end of the stem nearest the bore of the valve body.

Replaceable sealing elements are mounted within or on the ram bodies that extend into the vertical bore of the valve body of the BOP. When the pistons of the BOPs are moved to a closed position, commonly referred to as "closing the rams," the vertical bore of the BOP is sealed and the well bore pressure is contained. The sealing elements mounted within or on the ram bodies are available in a variety of configurations designed to seal the vertical bore of the BOP valve body when the opposing rams and pistons are moved to their closed position.

Several types of ram and seal assemblies are used in the actuator assemblies of a BOP stack. A BOP stack typically includes one type of ram and seal assembly known as a "blind ram" that seals across the entire wellbore when no wireline (or other tubular) is located in the vertical bore at the location of the blind rams. The blind rams are designed to engage each other when the BOP is closed. Blind rams typically utilize seals with no opening in the face of the seals such that the blind rams form a complete seal through the vertical bore of the BOP.

Another type of ram and seal assembly, known as a "wireline ram" (or "pipe ram" for BOPs used with other types of wellbore tubulars) utilizes seals designed to seal around the wireline (or other wellbore tubulars) within the BOP's vertical bore. Like blind rams, the wireline rams are designed to engage each other when the BOP is closed. Each seal of a wireline ram, however, typically has a semicircular opening in its front face to form a seal around half of the outer periphery of the wireline. When the wireline rams are closed, the opposing wireline rams engage each other and seal the entire periphery of the wireline, thereby closing off the annulus between the wireline and the well bore surface.

A third type of ram known as a shear, or cutting, ram is designed to shear the wireline (or other tubular) when the shear rams are driven toward each other as the BOP is closed. In operation, the shear rams are typically used as a last resort measure to contain wellbore pressure from causing a blowout. A BOP with shear rams is typically the top section of a ram-type BOP stack, while various pipe rams and blind rams are typically located below the shear rams.

Should it become necessary to actuate a wireline BOP, it is desirable for the wireline rams to guide the wireline (or other tubular) to the center of the vertical bore of the BOP as the rams close to ensure that the ram bodies and/or the metal bodies of the inner seals do not damage the wireline within the bore. Given the high cost of wireline, centering the wireline to prevent damage or loss is very important. For example, if wireline is damaged or severed as the ram bodies close and seal around the wireline, the replacement cost of such wireline can amount to nearly $300,000 per 30,000 feet of wireline.

Prior art U.S. Pat. No. 6,676,103 ("the '103 patent") discloses a guide system for centering wireline (or other tubular) in the vertical bore of the BOP when a set of wireline rams (or pipe rams) is closed. However, the guide system of the '103 patent has certain drawbacks, including the inability to replace the "guides" that guide the wireline (or other tubular) to the center of the vertical bore of the BOP without replacing the entire ram body, the distance between the guides and the seal assembly, and the potential for damaging the ram body in the event excessive "squeezing" force is imparted on the inner seal elements. Further, replacement of the sealing elements of such prior art pipe ram assemblies is more difficult, and requires extra expense, when compared to the inner guide seal assembly of the present invention.

The present invention offers an improved inner guide seal assembly that guides a wireline (or other tubular) to the center of the well bore and "energizes" the sealing elements of the assembly. The present invention helps prevent damage to the wireline due to misalignment and prevents the potential for excessive force building up in the inner seal elements such that they may deform or damage the ram bodies. Additionally, the inner guide seal assembly of the present invention allows for easy replacement of the entire seal assembly or, alternatively, replacement of the sealing element itself. Thus, the inner guide seal assembly of the present invention overcomes many of the drawbacks of the prior art.

SUMMARY OF THE INVENTION

An improved seal assembly used in ram-type BOPs is disclosed. The disclosed invention is a unique inner guide seal assembly that comprises a guide body and specially shaped sealing element. When a ram-type BOP is closed, two opposing rams move toward one another, causing the inner guide seal assembly of the present invention to guide a wireline (or other tubular) located in the vertical bore of the BOP to the center of the bore. By centralizing the wireline, the inner guide seal of the present invention helps ensure a positive seal around the wireline and helps prevent potential damage to the wireline.

In the preferred embodiment, the body of the inner guide seal assembly comprises a one-piece body having an upper plate and a lower plate integrally connected by multiple posts. This design feature prevents the body of the inner guide seal assembly from "expanding" during the sealing process, thereby preventing potential damage to the ram body.

Additionally, the upper and lower plates of the guide body include the guide surfaces that help guide the wireline (or other tubular) to the center of the vertical bore of the BOP when the rams are closed. By placing the guides on the inner seal assembly itself, the guides are closer to the centerline of the ram bodies, thereby maximizing the chances that the guides will be the first element to contact the wireline or tubular in the vertical bore of the BOP. Additionally, by keeping the guides as close to the centerline of the ram body as possible, it substantially reduces the possibility of the wireline laying angled or horizontally across the ram assembly, thereby helping prevent potential damage to the wireline. Further, by placing the guides on the inner seal assembly, the inner seals of existing ram bodies that currently do not have such guides can be replaced with the inner guide seal assembly of the present invention to provide such guides without having to replace the entire ram body.

The sealing element of the inner guide seal assembly is separate from the guide body and is formed as one piece with splits in the rear and center of the sealing element. This design feature allows the sealing element to be easily "opened" for placement onto (and removal from) the guide body. This feature facilitates replacement of the sealing elements without having to replace the entire inner guide seal assembly. Additionally, the inner guide seal assembly is not integral to the ram body and, thus, the assembly can be easily replaced without replacing the entire ram body.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

DESCRIPTION OF ILLUSTRATIVE EMBODIMENTS

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Figure 1:
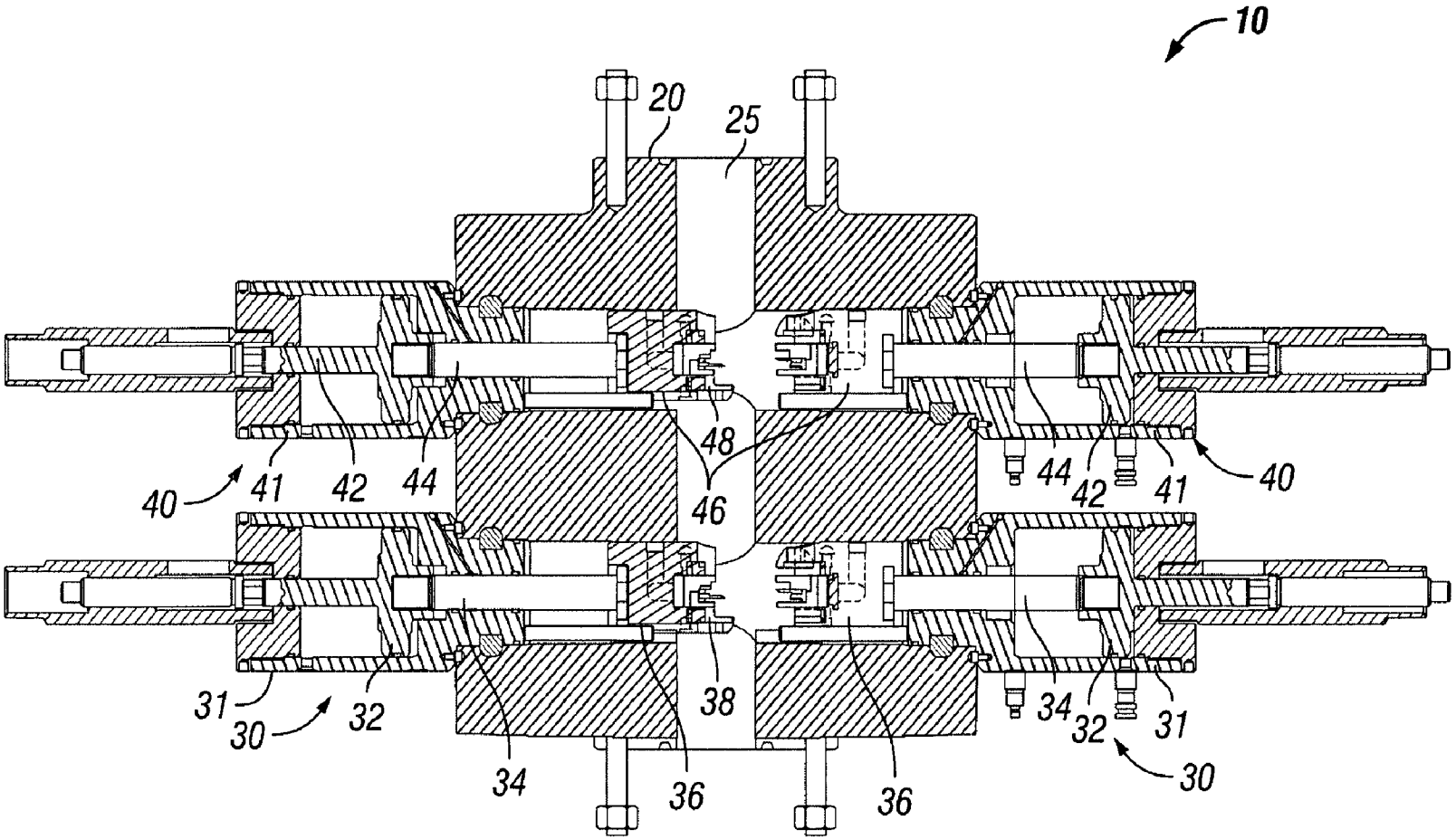
FIG. 1 is a vertical cross-sectional view of a typical BOP stack comprising multiple ram assemblies.

Referring to FIG. 1, a BOP stack 10 is shown in cross-section. As can be seen in FIG. 1, BOP stack 10 is comprised of valve body 20 (having central bore 25 running therethrough) with ram actuator assemblies 30 and 40.

Ram actuator assemblies 30 are the lowermost actuator assemblies connected to valve body 20. Each ram actuator assembly 30 comprises actuator body 31, piston 32, stem 34, ram body 36, and ram packer 38. Stem 34 operatively connects piston 32 with ram body 36.

Ram actuator assemblies 40 are connected to valve body 20 above ram actuator assemblies 30. Each ram actuator assembly 40 comprises actuator body 41, piston 42, stem 44, ram body 46, and ram packer 48. Stem 44 operatively connects piston 42 with ram body 46. Ram actuator assemblies 40 are substantially identical to ram actuator assemblies 30. Ram actuator assemblies 30 and 40 may differ in the type of ram seal employed in the assemblies. For example, ram actuator assemblies 30 may employ a set of blind rams, while ram actuator assemblies 40 may employ a set of wireline rams (or vice versa).

During well intervention operations, if the grease seal of a grease injection head fails, the pistons 32 within the lowermost ram actuator bodies 31 will be activated via hydraulic pressure (in normal operation) or manually (in the event of a failure of the hydraulic control system) such that the ram packers 38 will be driven laterally inwardly toward the vertical bore 25 running through valve body 20. As ram packers 38 are driven laterally and inwardly, the guide assembly will guide a wireline (or other tubular) within the vertical bore 25 to the center of the vertical bore 25. Eventually, the ram packers 38 of ram bodies 36 will be forced together such that the ram packers 38 will form a seal around the entire circumference of the wireline (or other tubular) passing through vertical bore 25. In this way, ram packers 38 are designed to hold back well pressure and to prevent wellbore fluids from migrating upwardly through vertical bore 25. Similarly, the pistons 42 within ram actuator bodies 41 may be activated as a redundant sealing mechanism or may be necessary in the event of a failure of the lowermost rams to hold back well pressure.

Figure 2:
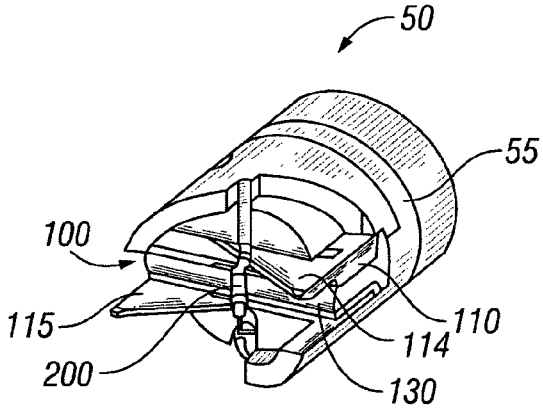
FIG. 2 is a perspective view of an inner guide seal assembly within a ram body in accordance with the preferred embodiment of the present invention.

Turning to FIG. 2, a perspective view of a wireline ram assembly in accordance with the present invention is shown. The wireline ram assembly of FIG. 2 comprises ram body 50 and inner guide seal assembly 100. Ram body 50 is a detailed illustration of the type of ram bodies 36 and 46 shown in FIG. 1.

As can be seen in FIG. 2, ram body 50 contains a seal groove for housing a seal that prevents wellbore fluids from flowing around the ram body when activated. Specifically, ram body 50 contains an outer seal groove that is shaped to receive a specially shaped outer seal 55. Outer seal 55 is curved to provide a seal along a substantial portion of the circumference of ram body 50 as shown in FIG. 2.

FIG. 2 also shows the inner guide seal assembly 100 of the present invention in its operational position within ram body 50. The inner guide seal assembly 100 can be easily inserted into ram body 50 for use, and can be easily removed from ram body 50 for replacement of the sealing element 130 or for replacement of the entire assembly 100.

Figure 3:
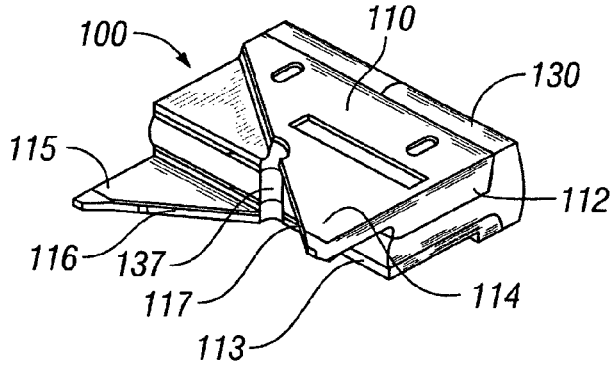
FIG. 3 is a perspective view of an inner guide seal assembly in accordance with the preferred embodiment of the present invention.

As seen in FIG. 2, and as shown in more detail in FIG. 3, the inner guide seal assembly 100 of the present invention comprises a specially-shaped guide body 110 sized and shaped to receive a sealing element 130. The guide body 110 and the sealing element 130 are separate components of the inner guide seal assembly 100, thereby allowing for independent replacement of either component.

The specially-shaped guide body 110 can be seen in more detail with reference to FIGS. 3 through 6. As shown in these figures, the guide body 110 is comprised of a top guide plate 112 having a guide nose 114 and a bottom guide plate 113 having a guide nose 115. Guide nose 114 and guide nose 115 are "angled" such that guide surface 116 of guide nose 115 and guide surface 117 of guide nose 114 will contact a wireline or other tubular in the vertical bore of the BOP first and force it along the guide noses 114 and 115 toward center notch 118 in the center of the guide body 110 as opposing ram bodies 50 are closed.

Figure 4:
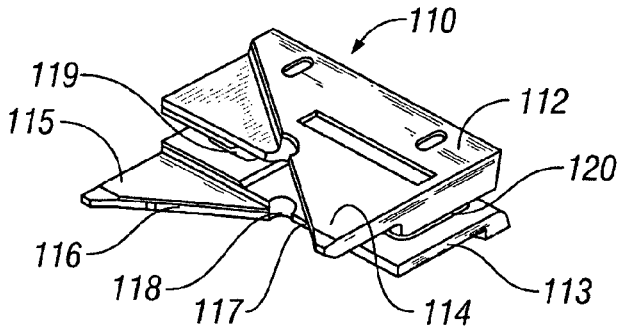
FIG. 4 is a perspective view of the guide body of the inner guide seal assembly shown in FIG. 3.
Figure 5:
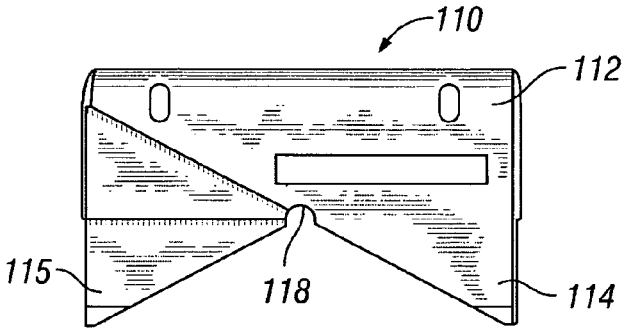
FIG. 5 is a top view of the guide body of the inner guide seal assembly shown in FIG. 4.
Figure 6:
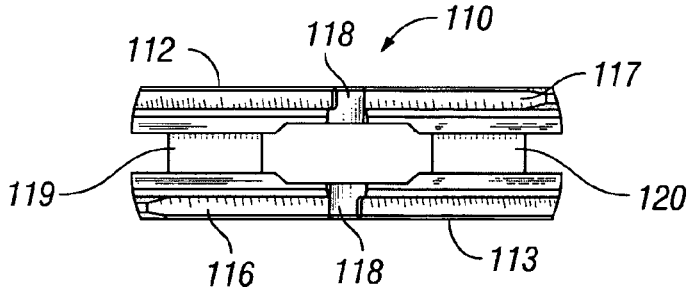
FIG. 6 is a front view of the guide body of the inner guide seal assembly shown in FIG. 4.

As shown in FIGS. 4 and 6, guide body 110 is manufactured as a one-piece body comprising top guide plate 112 and bottom guide plate 113 connected by posts 119 and 120. Guide body 110 is made of any suitable metal that can withstand the significant forces acting on the body when opposing ram bodies are closed around a wireline (or other tubular) in the vertical bore of the BOP. In the preferred embodiment, guide body 110 is cast as a one-piece body. One of skill in the art will appreciate that guide body 110 can be manufactured through other techniques, such as machining, EDM, or fabricating the guide body 110 out of a single piece of metal; however, such manufacturing techniques would be more expensive than casting guide body 110. Similarly, although guide body 110 is formed as one-piece in the preferred embodiment, one of skill in the art will appreciate that guide body 110 can be formed from separate guide plates and posts that are fastened together by any suitable metal-to-metal connection means, such as welding, to create guide body 110.

The use of posts 119 and 120 to connect top guide plate 112 and bottom guide plate 113 prevents guide body 110 from being deformed, and thereby potentially damaging ram body 50, in the event guide body 110 is exposed to excessive forces created by the expansion of sealing element 130 as ram bodies 50 are closed around a wireline (or other tubular). Specifically, as the ram bodies 50 move inwardly, front seal face 134 of the sealing elements 130 (refer to FIG. 7) of opposing ram bodies 50 come into contact. Additionally, a rearwardly directed axial force is exerted by the top and bottom guide plates 112 and 113 on the rear seal portion 132 of sealing elements 130 (refer to FIG. 7), thereby "pinching" rear seal portion 132 between the top and bottom guide plates 112 and 113 and the ram bodies 50. As a result of this "pinching," an opposite, forward directed axial force is transferred to the section of sealing element 130 that is "sandwiched" between the top and bottom guide plates 112 and 113. The contact of the front seal faces 134 of opposing ram bodies 50 prevents the release of such forces by preventing the sealing elements 130 from extruding out of the guide body 110. As a result, the forces attempt to "bulge" the section of the sealing element 130 that is sandwiched between the top and bottom guide plates 112 and 113, thereby creating forces that push outwardly on the top and bottom guide plates 112 and 113.

In prior art guide seal assemblies that lack posts 119 and 120, if these outwardly directed forces are great enough, they can cause the top and bottom plates of the seal assembly to exert forces on the ram bodies that can deform the ram bodies and/or cause the seal assemblies to become stuck in the ram bodies. Unlike the prior art seal assemblies, the posts 119 and 120 of the present invention maintain the top and bottom guide plates 112 and 113 a set distance apart from each other and prevent them from exerting a potentially deforming force on the ram bodies. While the preferred embodiment of the present invention uses two posts, one of skill in the art will appreciate that one, two, three, or even more posts between the top and bottom guide plates can be used.

Figure 7:
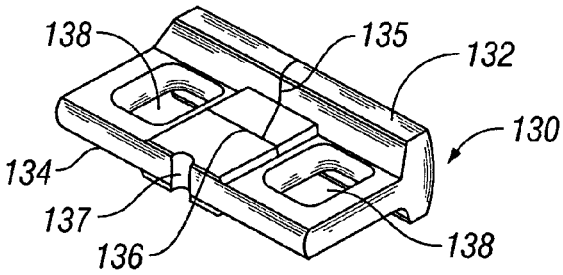
FIG. 7 is a perspective view of the specially-shaped sealing element of the inner guide seal assembly shown in FIG. 3.

Referring to FIG. 7, the sealing element 130 is shown in greater detail. Sealing element 130 is specially shaped to fit within guide body 110. As noted above, seal element 130 includes rear seal portion 132 that contacts ram body 50 and front seal face 134 that contacts a corresponding front seal face 134 on an opposing ram body 50 when the ram bodies are closed. Center notch 137 in the front seal face 134 is designed to receive and form a seal around a wireline (or other tubular) within the bore of the BOP when opposing ram bodies 50 are closed. FIG. 7 also shows two specially-shaped openings 138 formed in the sealing element 130 that are sized and shaped to accept and seal around posts 119 and 120 when the sealing element 130 is placed within guide body 110.

Sealing element 130 is designed to be easily inserted into and removed from guide body 110 for easy and cost effective replacement of such seal. Specifically, as shown in FIG. 7, sealing element 130 is designed with rear split 135 and center split 136 that allow sealing element 130 to be "opened" for easy positioning within guide body 110 prior to insertion of the complete inner guide seal assembly 100 into ram body 50.

In operation, when the ram bodies 50 are driven laterally inward, the guide surface 116 of guide nose 115 and the guide surface 117 of guide nose 114 will contact a wireline (or other tubular) in the vertical bore of the BOP and force it along the guide noses 114 and 115 toward center notch 118 in the center of the guide body 110 and center notch 137 of the sealing element 130. Ultimately, the wireline (or other tubular) is received and held in center notch 137 in the sealing element 130. When the ram bodies 50 are completely closed, the contact between the front seal surface 134 of opposing sealing elements 130 (as well as the mating of center notches 137 around the circumference of the wireline) forms a seal in the annulus between the wireline (or other tubular) and the vertical bore of the BOP.

By utilizing guide noses 114 and 115 that are integrally formed with the top and bottom guide plates 112 and 113, the guide noses 114 and 115 are closer to the centerline of the ram body 50, thereby maximizing the chances that the guide surfaces 116 and 117 will be the first element to contact the wireline (or other tubular) in the vertical bore of the BOP. This helps to substantially reduce the possibility for the wireline to lay angled or horizontal across the ram face and helps ensure no damage is caused to the wireline. Further, by placing the guide noses 114 and 115 on the inner guide seal assembly 100, the inner seals of existing ram bodies that currently do not have such guides can be replaced with the inner guide seal assembly 100 of the present invention to provide such guides without having to replace the entire ram body.

While the apparatus, compositions and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

The invention claimed is:

1. An inner seal assembly for a ram-type blowout preventer comprising:

a guide body adapted for positioning within a ram body, the guide body comprising:

an upper guide plate and a lower guide plate, the upper and lower guide plates each having a guide nose extending outwardly from the upper and lower guide plates and angled inwardly toward a center notch adapted to receive a wireline;

one or more posts connecting the upper and lower guide plates together, wherein the one or more posts maintain a constant distance between the upper and lower guide plates as opposing ram bodies of the blowout preventer are actuated; and space between the upper and lower guide plates for receiving a sealing element;

wherein the sealing element has one or more slits to facilitate the removal of the sealing element from the guide body without disassembly of the guide body.

2. The inner seal assembly of claim 1 wherein the guide noses of the upper and lower guide plates are designed to center the wireline within a vertical bore of the blow-out preventer as the guide noses contact the wireline when opposing ram bodies of the blow-out preventer are actuated.

3. The inner seal assembly of claim 2 wherein the guide noses are angled such that a surface of the guide noses contacts the wireline first as opposing ram bodies of the blow-out preventer are actuated.

4. The inner seal assembly of claim 1 wherein the guide noses are integrally formed as part of the guide plates.

5. The inner seal assembly of claim 1 wherein the upper and lower guide plates and the one or more posts are manufactured as a one-piece body.

6. The inner seal assembly of claim 1 wherein the upper and lower guide plates are manufactured as independent pieces and are connected together by the one or more posts to form the guide body.

7. The inner seal assembly of claim 1 wherein the sealing element can be removed from the guide body in order to replace the sealing element.

8. The inner seal assembly of claim 7 wherein the sealing element comprises one or more openings for receiving the one or more posts when the sealing element is positioned within the guide body.

9. The inner seal assembly of claim 1 wherein the sealing element is made out of an elastomeric material.

10. The inner seal assembly of claim 1 wherein the center notch comprises a center notch in the sealing element and a center notch in the upper and lower guide plates for receiving the wireline as opposing ram bodies of the blow-out preventer are closed around the wireline.

11. An inner seal assembly for a ram-type blowout preventer comprising:

a guide body adapted for positioning within a ram body of a ram-type blowout preventer, the guide body comprising:

an upper guide plate and a lower guide plate, wherein each of the upper and lower guide plates have a guide nose extending outwardly from the upper and lower guide plates and angled inwardly toward a center notch adapted to receive a wireline;

a plurality of posts connecting the upper and lower guide plates together, wherein the plurality of posts maintain a constant distance between the upper and lower guide plates as opposing ram bodies of the blowout preventer are actuated; and a gap between the upper and lower guide plates; and a sealing element having a plurality of openings for receiving the plurality of posts and having one or more slits to facilitate removal of the sealing element from the guide body without disassembly of the guide body.

12. The inner seal assembly of claim 11 wherein the guide noses of the upper and lower guide plates are designed to center the wireline within a vertical bore of the blow-out preventer as the guide noses contact the wireline when opposing ram bodies of the blow-out preventer are actuated.

13. The inner seal assembly of claim 12 wherein the guide noses are angled such that a surface of the guide noses contacts the wireline first as opposing ram bodies of the blow-out preventer are actuated.

14. The inner seal assembly of claim 11 wherein the upper and lower guide plates and the plurality of posts are manufactured as a one-piece body.

15. The inner seal assembly of claim 11 wherein the sealing element is made out of an elastomeric material.

16. The inner seal assembly of claim 11 wherein the sealing element can be removed from the guide body in order to replace the sealing element.

17. A method of centering and sealing around a wireline within a ram-type blowout preventer, the method comprising:

providing a guide body, the guide body comprising an upper guide plate and a lower guide plate, wherein the upper and lower guide plates each have a guide nose extending outwardly from the upper and lower guide plates and angled inwardly toward a center notch adapted to receive the wireline; one or more posts connecting the upper and lower guide plates together, wherein the one or more posts maintain a constant distance between the upper and lower guide plates as opposing ram bodies of the blowout preventer are actuated; and a gap between the upper and lower guide plates;

positioning a sealing element within the gap between the upper and lower guide plates of the guide body, the sealing element comprising one or more openings for receiving the one or more posts and having one or more slits to facilitate removal of the sealing element from the guide body without disassembly of the guide body;

positioning a guide body within each ram body of opposing rams of the blowout preventer;

actuating the opposing rams such that the ram bodies move inwardly towards a central bore of the blowout preventer;

contacting the wireline with the guide noses of the upper and lower guide plates of each guide body;

forcing the wireline to move along the guide noses of the upper and lower guide plates of each guide body toward the center of the central bore of the blowout preventer; and forcing the sealing elements within opposing ram bodies into contact with each other such that the sealing elements form a seal around the wireline.

18. The method of claim 17 wherein the center notch comprises a center notch in the upper and lower guide plates and in the sealing element for receiving the wireline.

19. The method of claim 17 further comprising manufacturing the upper and lower guide plates and the one or more posts as a one-piece body.

20. The method of claim 17 further comprising making the sealing element out of an elastomeric material.

* * * * *